US007690880B2

(12) United States Patent
Honeyman et al.

(10) Patent No.: US 7,690,880 B2
(45) Date of Patent: Apr. 6, 2010

(54) LOCKING DEVICE FOR HYDRAULIC ATTACHMENT INTERFACE

(75) Inventors: Russell A. Honeyman, Bismarck, ND (US); David E. Marotte, Bismarck, ND (US); Gerald J. Duppong, Bismarck, ND (US); David W. Graf, Mandan, ND (US); Wally L. Kaczmarski, Lisbon, ND (US)

(73) Assignee: Clark Equipment Company, West Fargo, ND (US)

( * ) Notice: Subject to any disclaimer, the term of this patent is extended or adjusted under 35 U.S.C. 154(b) by 941 days.

(21) Appl. No.: 11/411,162

(22) Filed: Apr. 25, 2006

(65) Prior Publication Data

US 2007/0248445 A1 Oct. 25, 2007

(51) Int. Cl.
*E02F 3/28* (2006.01)

(52) U.S. Cl. ..... 414/723; 37/468

(58) Field of Classification Search ..... 414/680, 414/685, 723; 37/468; 92/65; 403/31, 37, 403/38, 39

See application file for complete search history.

(56) References Cited

U.S. PATENT DOCUMENTS

| | | | | |
|---|---|---|---|---|
| 3,873,133 | A | 3/1975 | Berg et al. | |
| 4,203,684 | A | 5/1980 | Stecklein | |
| 4,311,428 | A | 1/1982 | Arnold | |
| 5,125,788 | A | 6/1992 | Stenger | |
| 5,546,683 | A | 8/1996 | Clark | |
| 5,791,863 | A * | 8/1998 | Droegemueller | 414/723 |
| 5,802,753 | A | 9/1998 | Raunisto | |
| 5,865,594 | A | 2/1999 | Kim | |
| 6,231,296 | B1 | 5/2001 | Blomgren | |
| 6,332,747 | B1 | 12/2001 | Lee | |
| 6,385,872 | B1 | 5/2002 | Mieger et al. | |
| 6,408,875 | B1 | 6/2002 | Nishikawa et al. | |
| 6,425,730 | B1 | 7/2002 | Kacamarski | |
| 6,513,268 | B2 | 2/2003 | Lee et al. | |
| 7,311,489 | B2 * | 12/2007 | Ekman | 414/723 |

FOREIGN PATENT DOCUMENTS

| | | |
|---|---|---|
| EP | 1 258 567 | 11/2002 |
| JP | 09 041418 | 2/1997 |
| JP | 2001 329562 | 11/2001 |
| JP | 2003 160949 | 6/2003 |
| WO | WO 01/16433 | 3/2001 |

OTHER PUBLICATIONS

European Search Report Application No. 072516959.04-1256 dated Feb. 2, 2009.

European Patent Application No. 07251659.4-1256/1849921 Communication Pursuant to Article 94(3) EPC dated Oct. 14, 2009.

* cited by examiner

*Primary Examiner*—Donald Underwood
(74) *Attorney, Agent, or Firm*—Westman, Champlin & Kelly, P.A.

(57) ABSTRACT

An interface between a hydraulic power system and an hydraulically actuated engagement member includes a first portion that is pivotally coupled to a second portion, and has an inlet capable of being coupled to the power system. The second portion is fixedly attached to an attachment bracket capable of interfacing with an attachment. The first portion has a path to provide oil to the second portion, which in turn provides oil from the first portion to the attachment bracket. The attachment bracket includes a housing that accepts an engagement member capable of being hydraulically actuated to secure or release the attachment with respect to the power machine.

21 Claims, 10 Drawing Sheets

LOCKING DEVICE FOR HYDRAULIC ATTACHMENT INTERFACE

BACKGROUND

The disclosed embodiments relate to interchangeable tool attachments such as buckets, grapples, hydraulic hammers, tampers, augers and the like used with a power operated arm of an implement such as an excavator or backhoe. More particularly, the embodiments relate to an attachment device that allows attachments to be quickly attached to the power operated arm.

FIG. 1A illustrates a prior art attachment mounting bracket 22 pivotally attached to an end portion of an excavator arm 18 (shown in fragmentary view) at boom arm pivot joint 20. Excavator arm 18 is attached to an excavator or backhoe represented by block 10. Quick attachment mount 22 is also pivotally attached to hydraulic cylinder 14 through a cylinder link 26. Hydraulic cylinder 14 is attached to a portion of the excavator or backhoe and is in communication with hydraulic controls represented by block 12 located on the excavator or backhoe. A cross link 32 is pivotally attached to both the end of cylinder rod 16, which extends from hydraulic cylinder body 14 and excavator arm 18. The cross link 32 is attached to the excavator arm 18 at cross link pivot joint 36. A pin 34 extends through both the cross link 32 and the excavator arm 18 to provide a pivotal attachment. Likewise, a pin 30 at cylinder link pivot joint 28 pivotally attaches the cylinder rod 16 with both the cross link 32 and the cylinder link 26. Cylinder link 26 is pivotally attached to the quick attachment mount 22 at pivot 25, with a pin 27 extending through both the cylinder link 26 and the quick attachment mount 22.

A fragmentary portion of an attachment 40 is partially engaged with the quick attachment mount 22 at pin 38. Attachment 40 includes an engagement region 44 which is adapted to engage with support region 46 of quick attachment mount 22 when the quick attachment mount is rotated about pin 38 in the direction of arrow 48. The attachment 40 is then secured to the quick attachment mount 22 at support region 46.

When the attachment 40 is fixedly attached to the attachment mount 22, actuation of the hydraulic cylinder 14 to extend or retract the cylinder rod 16 will cause the attachment 40 to pivot about boom arm pivot joint 20. Attachments of the type used with excavators or back hoes can have a pivotal rotation of approximately 270 degrees.

FIG. 1B illustrates in more detail the prior art quick attachment mount 22. Quick attachment mount 22 includes a first side plate 50 and a second side plate 52. First side 50 and second side 52 each have a pair of apertures 21 and 23 formed through them in position such that when quick attachment mount 22 is positioned with respect to excavator arm 18 the aperture 21 in FIG. 1B aligns with the boom arm to create the boom arm pivot joint 20. Similarly, the aperture 23 in FIG. 1B is aligned to engage cylinder link 26 to create pivot 25.

Side plates 50 and 52 are attached and joined together by a retainer or cradle 42. Retainer 42 and first and second sides 50 and 52 collectively hold a pin 38. Pin 38 is positioned to extend outside the width of retainer 42 to provide an engagement surface for an attachment. First side 50 and second side 52 are also connected via a support region 46, a multi-surfaced crossmember that extends along an end of the each of the first and second sides.

As shown in FIG. 1A, attachment 40 engages pin 38 and is capable of rotating on pin 38 in either direction. When the quick attachment mount 22 is rotated in position such that engagement region 44 is in connection with or is positioned adjacent support region 46, a portion of the attachment 40 is positioned adjacent to retainer or cradle 42. Thus the cradle 42 serves to assist in holding the attachment in place with respect to the quick attachment mount 22.

Support region 46 is positioned to engage and support the engagement region 44 of attachment 40 when the quick attachment mount 22 is rotated into position. In addition, the engagement region 44 has a pair of bores (not shown) that match up with a pair of bores 54 that extend through the engagement surface 46. Thus, when the attachment 40 is rotated into position, the attachment can be fixedly secured to the quick attachment mount 22. Typically, a fastener arrangement such as a nut and bolt or a pin of some sort is extended through the aligned bores to fixedly attach the attachment to the attachment mount 22.

However, requiring the use of fasteners such as nuts and bolts to secure the attachment to the attachment mount is time consuming. Often times, an operator wants to quickly disengage one attachment and engage a second attachment to do different types of work at a work site. Thus, what is needed is an attachment mount that provides a quicker and easier method of attaching the attachment to the attachment mount.

SUMMARY

One embodiment is directed toward an hydraulic interface between a power machine having an hydraulic power system and an attachment mounting bracket having an hydraulically actuated engagement member. The hydraulic interface includes a first portion capable of being coupled to the hydraulic power system and a second portion fixedly attached to the attachment mounting bracket. The first portion is pivotally coupled to the second portion so that the attachment bracket is capable of pivoting with respect to the first portion of the hydraulic interface. The second portion includes an outlet capable of providing oil from the outlet of the first portion to the attachment mounting bracket. The hydraulic interface can include a third portion that is also pivotally coupled to the second portion and is fixedly attached to the first portion. The third portion can include an inlet capable of being coupled to the hydraulic power system and an outlet. The second portion can further include an outlet capable of providing oil from the outlet of the third portion to the attachment mounting bracket. The attachment mounting bracket is pivotable with respect to the power machine and the hydraulically actuated engagement member can be actuated to secure or release an attachment with respect to the attachment mounting bracket.

One embodiment is directed toward an attachment interface system configured to couple an attachment to a power machine. The power machine has an hydraulic power system and at least one arm with an attachment mounting bracket pivotally attached to the at least one arm. The attachment bracket includes a housing with an engagement member located therein capable of moving from a first position to a second position to engage and secure the attachment to the mounting bracket. The system further includes an hydraulic interface member fixedly attached to the mounting bracket and capable of providing hydraulic oil to the housing to move the engagement member from a first to a second position. At least a portion of the hydraulic interface member is capable of pivoting with respect to the mounting bracket.

One embodiment is directed toward a method of providing an attachment interface between a power machine and an attachment. The method includes pivotally attaching a mounting bracket to the power machine having at least one attachment engagement member, capable of moving between a first position and a second position under hydraulic power. A hydraulic interface is provided between the power machine and the mounting bracket. The hydraulic interface is fixedly attached to the mounting bracket and includes an internal path for receiving hydraulic oil from the hydraulic power source and providing oil to the mounting bracket to manipulate the attachment engagement member. The hydraulic interface includes a first portion, which is pivotable with respect to a second portion, which is fixedly attached to the mounting bracket. The hydraulic interface is connected to the hydraulic power source and oil is provided in response to an operator input to the mounting bracket to move the engagement member between the first and second position.

BRIEF DESCRIPTION OF THE DRAWINGS

The concepts presented herein will be further explained with reference to the attached figures, wherein like structure or system elements can be referred to by like reference numerals throughout the several views.

While the above-identified figures set forth one or more embodiments, other embodiments are also contemplated, as noted herein. In all cases, concepts presented herein describe the embodiments by way of representation and not by limitation. It should be understood that numerous other modifications and embodiments can be devised by those skilled in the art which fall within the scope and spirit of the principles of these embodiments.

DETAILED DESCRIPTION

Figure 2:
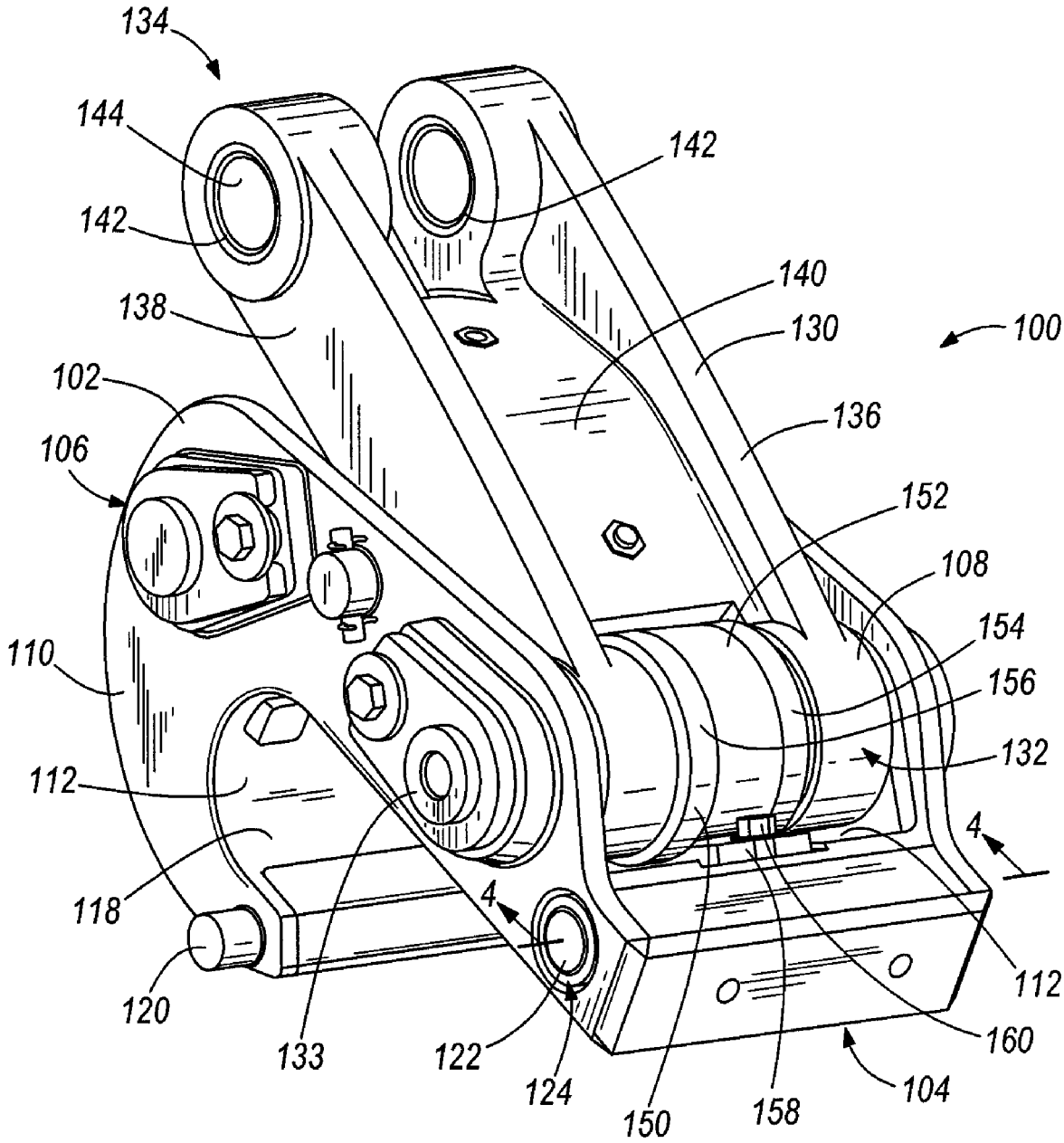
FIG. 2 is a perspective view of a hydraulic quick attachment mounting bracket having hydraulically actuated attachment engagement members and coupled to both a link capable of being attached to an actuator and a pivotable hydraulic interface according to one embodiment.

FIG. 2 illustrates a quick attachment assembly 100 having hydraulically actuated extendable engagement members or pins 122, the assembly being of the type adapted to be connected to the end of an arm such as excavator arm 18 according to one embodiment. Quick attachment assembly 100 includes quick attachment mounting bracket 102 and cylinder link assembly 130, which is pivotally attached to the quick attachment mounting bracket at pivot joint 133. In addition, an hydraulic interface 150 is coupled to the quick attachment assembly at pivot 133. Hydraulic interface 150, which will be discussed in more detail below, is configured to be attached to an hydraulic power supply (not shown). In addition, hydraulic interface 150 is fixedly coupled to quick attachment mounting bracket 102 to provide hydraulic control engagement pins 122.

Quick attachment mounting bracket 102 includes a first side 108 and a second side 110 coupled together on either side of a cross member 112. The first and second sides 108 and 110 are substantially similarly shaped and extend generally linearly from a proximal end 104 of the quick attachment mounting bracket to a distal end 106. At the distal end 106 of the quick attachment mounting bracket 102, the first and second sides 108 and 110 curve downwardly and toward the proximal end 104 of the quick attachment mounting bracket. The curved shape of the first and second sides 108 and 110 together with the cross member 112, which follows the shape of the first and second sides, provide an attachment cradle or retainer 118 capable of supporting a portion of an attachment such as the attachment 40 shown in a fragmentary view in FIG. 1A. A pin 120 extends from the second side 110 in the region of the attachment cradle 118. A second pin (not shown) similarly extends from the first side 108 of the quick attachment mounting bracket 112 in a similar position.

Figure 1A:
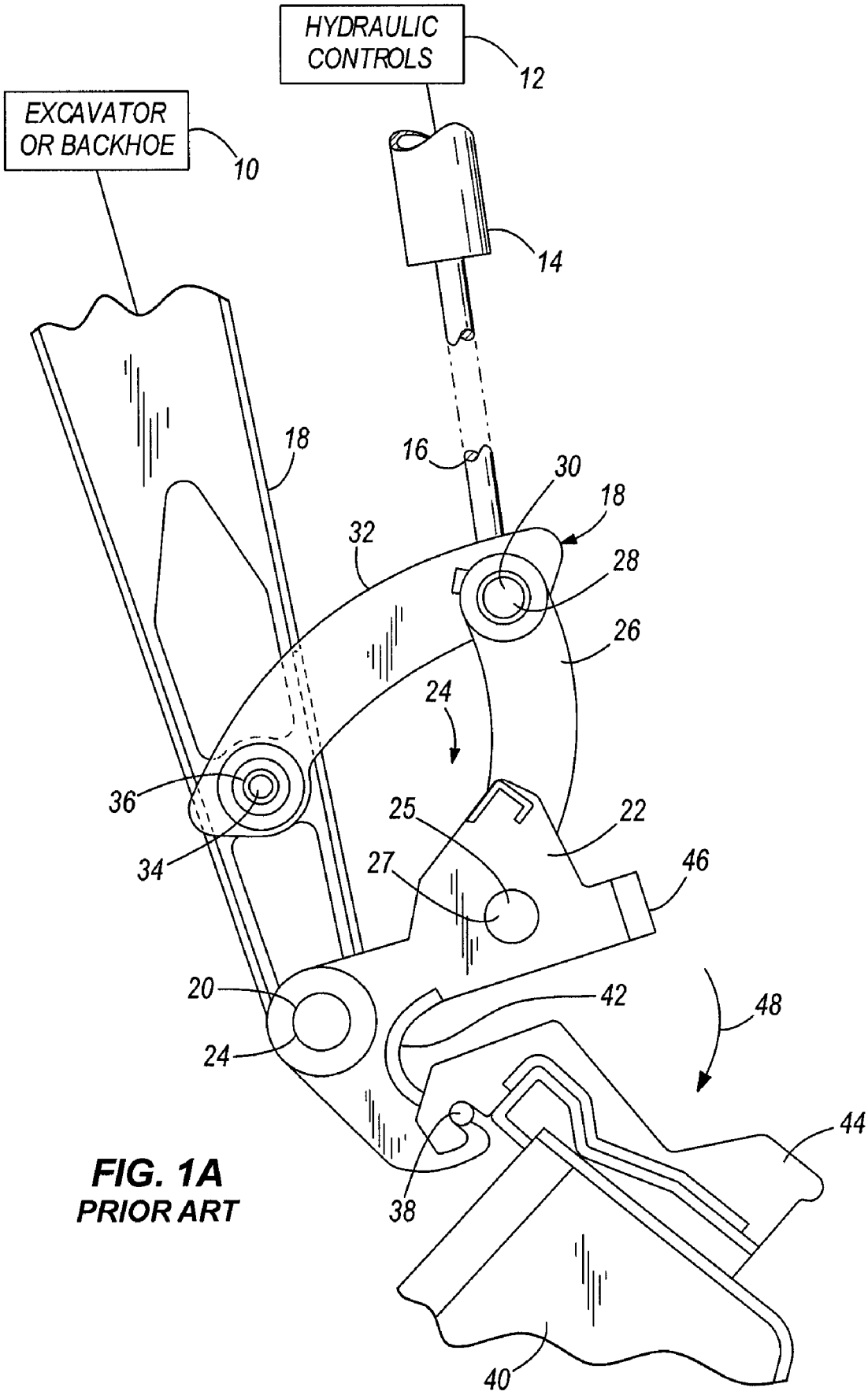
FIG. 1A PRIOR ART
FIG. 1A is schematic side elevational view of a typical excavator arm end portion having an attachment mounting bracket according to the prior art.
Figure 1B:
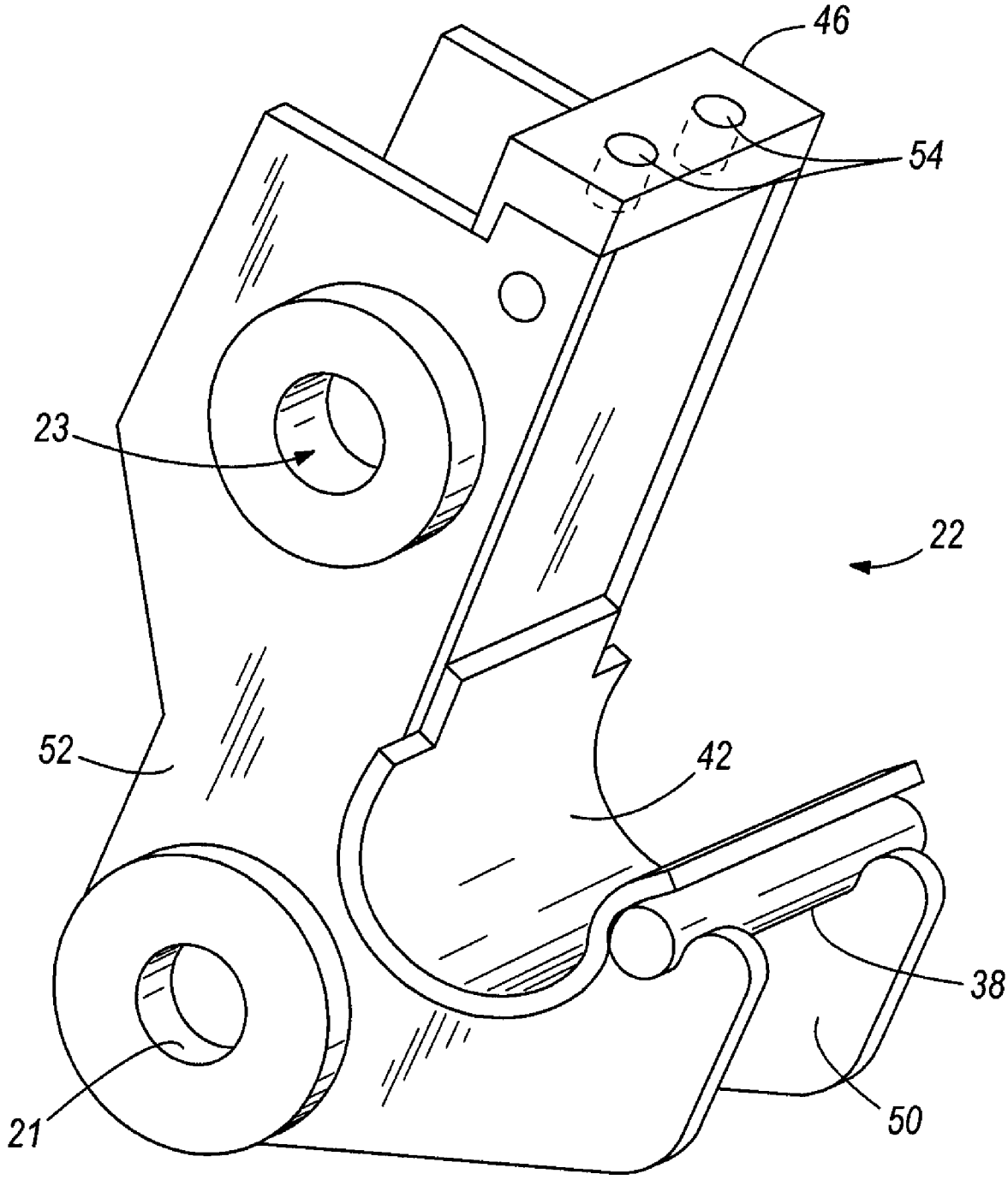
FIG. 1B PRIOR ART
FIG. 1B is a perspective schematic view of the attachment mounting bracket shown in FIG. 1A.

The pins 120 are configured to accept and support a portion of the attachment similar to pin 38 shown in FIGS. 1A and 1B. In addition, the quick attachment assembly 100 includes the engagement members or pins 122 (one of which is shown in a retracted position on second side 110) capable of extending from each of the first and second sides 108 and 110 of the quick attachment mounting bracket 102 near the proximal end 104 of the quick attachment mounting bracket. The quick attachment mounting bracket 102 includes a housing 124 located between the first and second sides 108 and 110, which will be discussed in greater detail below.

Cylinder link assembly 130 is shown coupled to the quick attachment mounting bracket 102 at pivot joint 133. Cylinder link assembly 130 has a first link 136 and second link 138 each coupled to a cross member 140 that extends between a portion of the first and second links. Each of the first and second links 136 and 138 have a bore 142 formed into a proximal end 132 and a distal end 134 of the cylinder link assembly 130. The bores 142 are positioned to accept a pin (not shown) extending through the bore to attach the cylinder link to the quick attachment mounting bracket 102 on the proximal end 132 and a cylinder or other links or brackets (not shown) on the distal end 134 of the cylinder link. A bushing 144 is inserted into each of the bores 142 to provide an engagement surface for the pins where they are inserted into the bores.

Returning again to the pivot joint 133, a pin (not shown) extends through the first and second sides 108 and 110 of the quick attachment mounting bracket 102 and the first and second links 136 and 138 of the cylinder link assembly 130 to pivotally connect the cylinder link assembly to the quick attachment mounting bracket 102. In addition, a hydraulic interface 150 is positioned between the first and second links 136 and 138 of the cylinder link assembly 130. The hydraulic interface 150 is adapted to accept a pin (not shown) through its center portion to secure the hydraulic interface between the first and second links 136 and 138 of the cylinder link assembly. The hydraulic interface 150 includes a center portion 152, which, in one embodiment, is surrounded by a first end portion 154 and second end portion 156. The center portion 152 of the hydraulic interface is fixedly attached to the quick attachment mounting bracket 102. As is shown in FIG. 2, the center portion 152 of the hydraulic interface 150 includes a bracket 158 positioned to extend along a portion of the cross member 112 of the quick attachment mounting bracket 102. The bracket 158 is attached to the cross member 112 with two fasteners 160 (only one shown), although any suitable fastening structure may be used, such as, for example, a weld, a clip, or a clamp.

As has been discussed above, cylinder link assembly 130 is pivotally connected to quick attachment mounting bracket 102 to allow the quick attachment mounting bracket to pivot with respect to the cylinder link assembly as the cylinder rod (not shown), which is attached to the cylinder link assembly, extends or retracts. Because the center portion 152 of the hydraulic interface 150 is fixedly attached to the cross member 112, the center portion will pivot with the quick attachment mounting bracket 102. As will be discussed below, the first end portion 154 and the second end portion 156 are not fixedly attached to the hydraulic interface 150. Thus, the first end portion 154 and the second end portion 156 do pivot with respect to the center portion 152 of the hydraulic interface 150 when the quick attachment mounting bracket 102 pivots with respect to cylinder link assembly 130.

Figure 3:
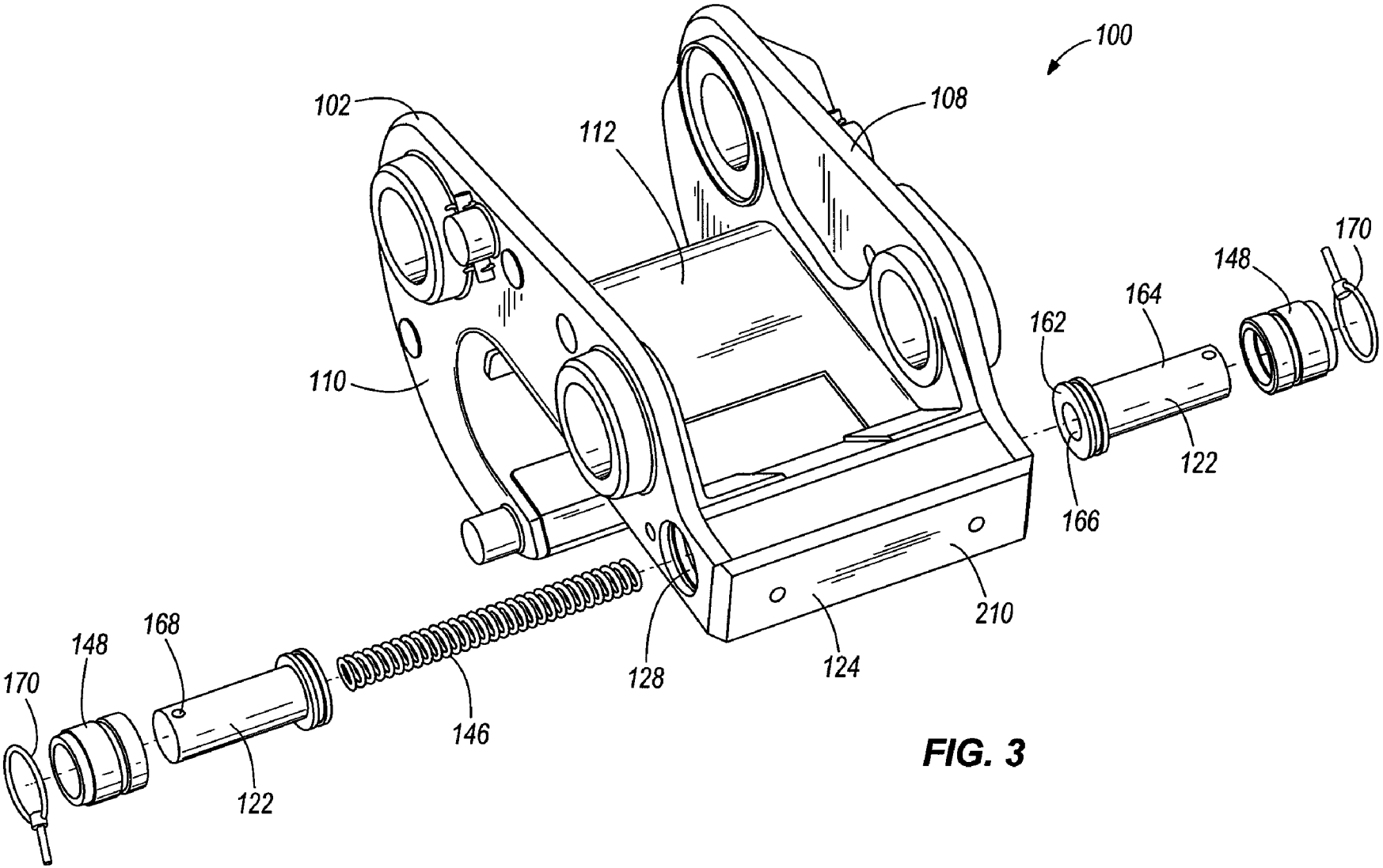
FIG. 3 is an exploded view of a portion of the hydraulic quick attachment mount of FIG. 2, illustrating the components located within a housing, including the hydraulically actuated attachment retaining members.

FIG. 3 illustrates an exploded view of the quick attachment mounting bracket 102 of assembly 100 with an exploded view of the components located within the housing 124. Housing 124 includes a cavity 128 that extends therethrough the first side 108 to the second side 110. Housing 124 houses a pair of the engaging pins 122, which are capable of extending out of cavity 128 on each of the first and second sides 108 and 110 of the quick attachment mounting bracket 102. In one embodiment, the pins 122 are hydraulically actuated to extend and retract in response to an operator input. Hydraulic oil ported into and out of the housing 124 will cause the pins to extend or retract, the details of which will be discussed below. Engaging pins 122, when retracted, are positioned within the cavity 128.

Engaging pins 122 include a base 162 and a rod 164 attached to and extending from the base. An internal bore 166 is formed through the base 162 and into the rod 164. A cross bore 168 is formed through the rod 164 of engaging pin 122 near an end opposing the base 162. A spring 146 is positioned within the cavity 128 and is sized and positioned to extend into the internal bore 166 of each of the engaging pins 122. Spring 146 will be discussed in detail below. Bushing 148 is adapted to fit snugly over the rod 164 of pin 122 and within the cavity 128. A retaining pin 170, which in one embodiment is a lynch pin, is adapted to fit into the cross bore 168 of each of the engaging pins 122 when the pins 122 are extended.

Figure 4A:
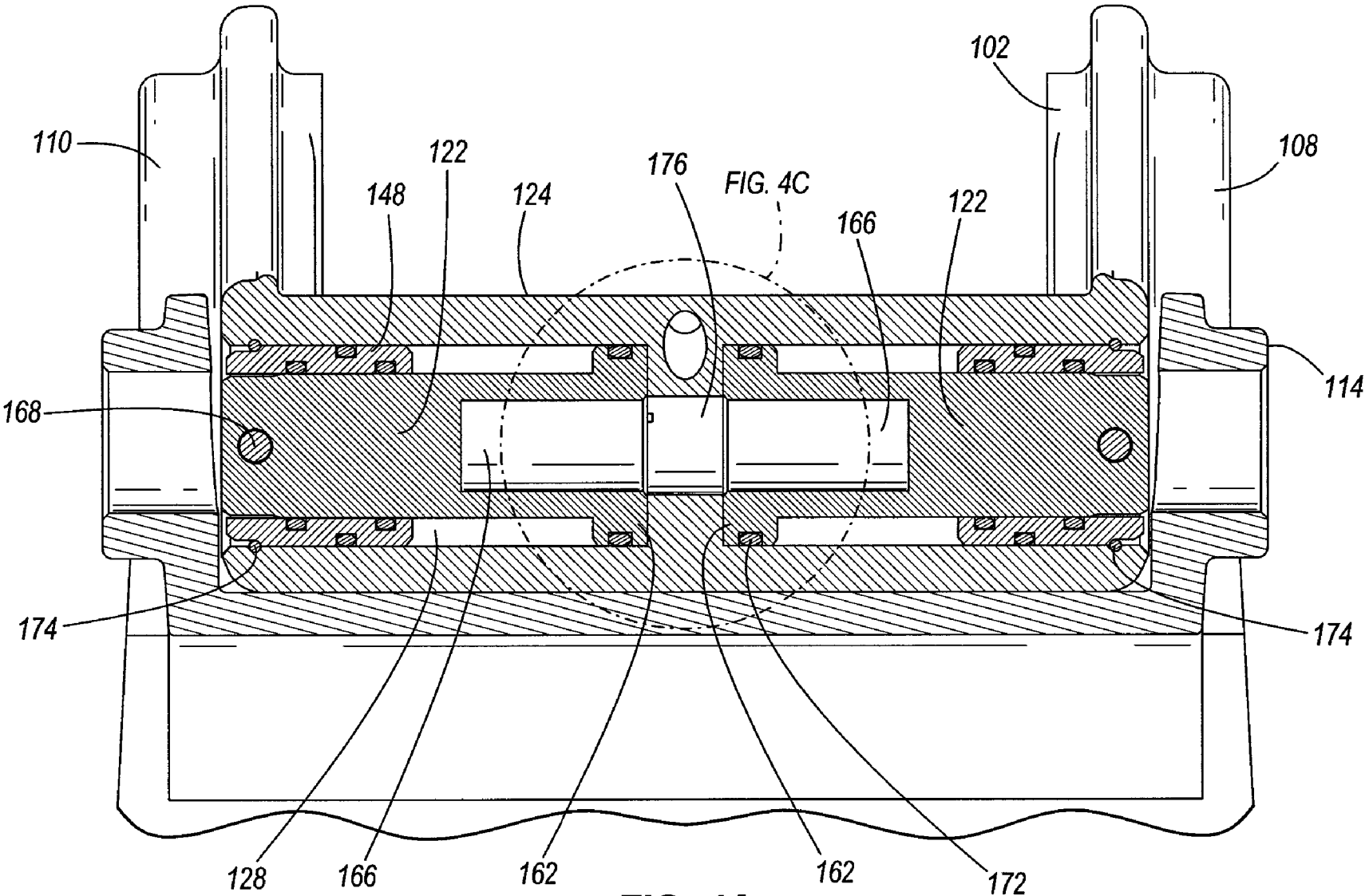
FIG. 4A is a cross-sectional view of the housing taken along line 4-4 in FIG. 2 according to one embodiment, illustrating the engagement members in a retracted position.
Figure 4B:
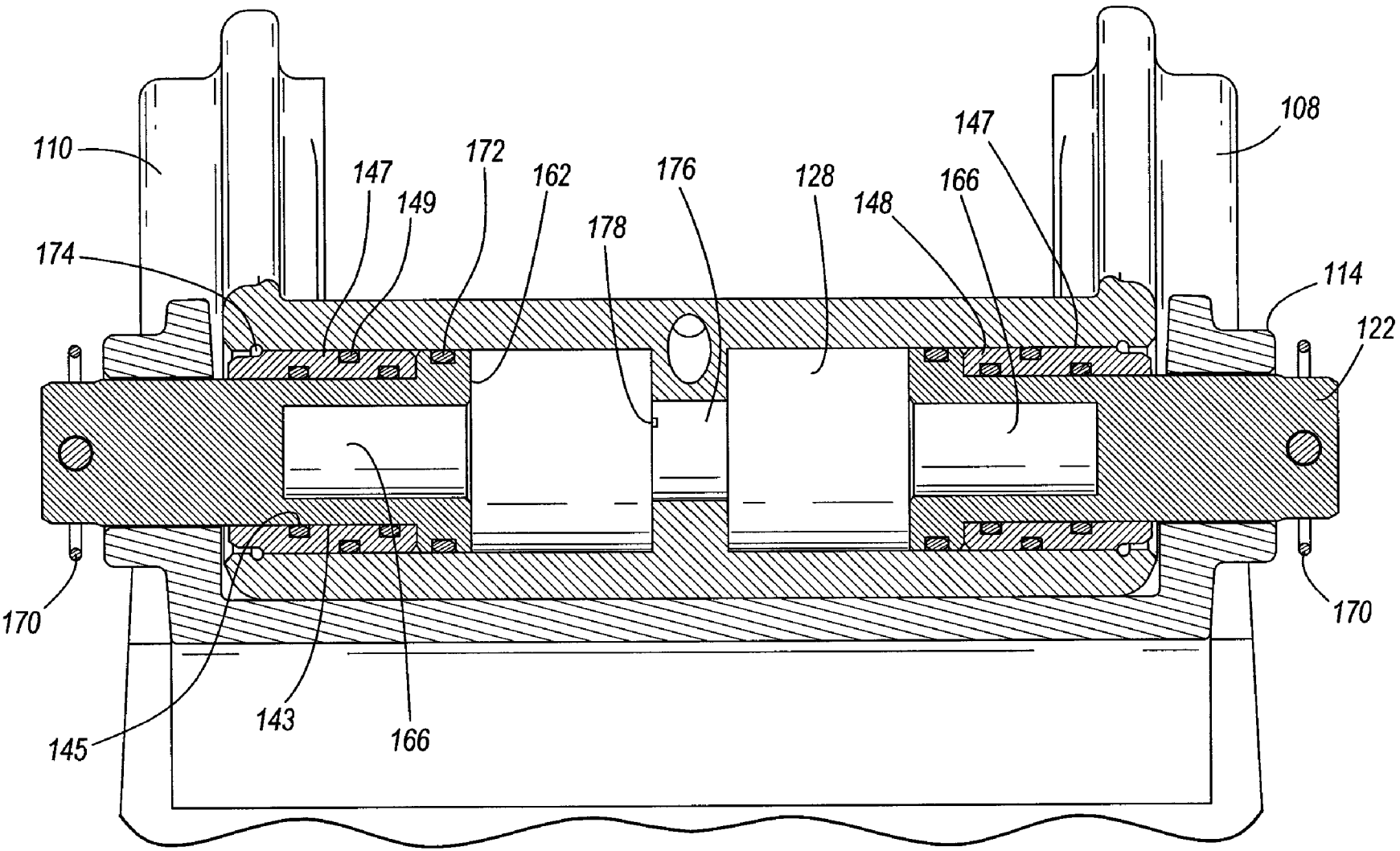
FIG. 4B is a cross-sectional view of the housing taken along line 4-4 in FIG. 2, illustrating the engagement members in an extended position.
Figure 4C:
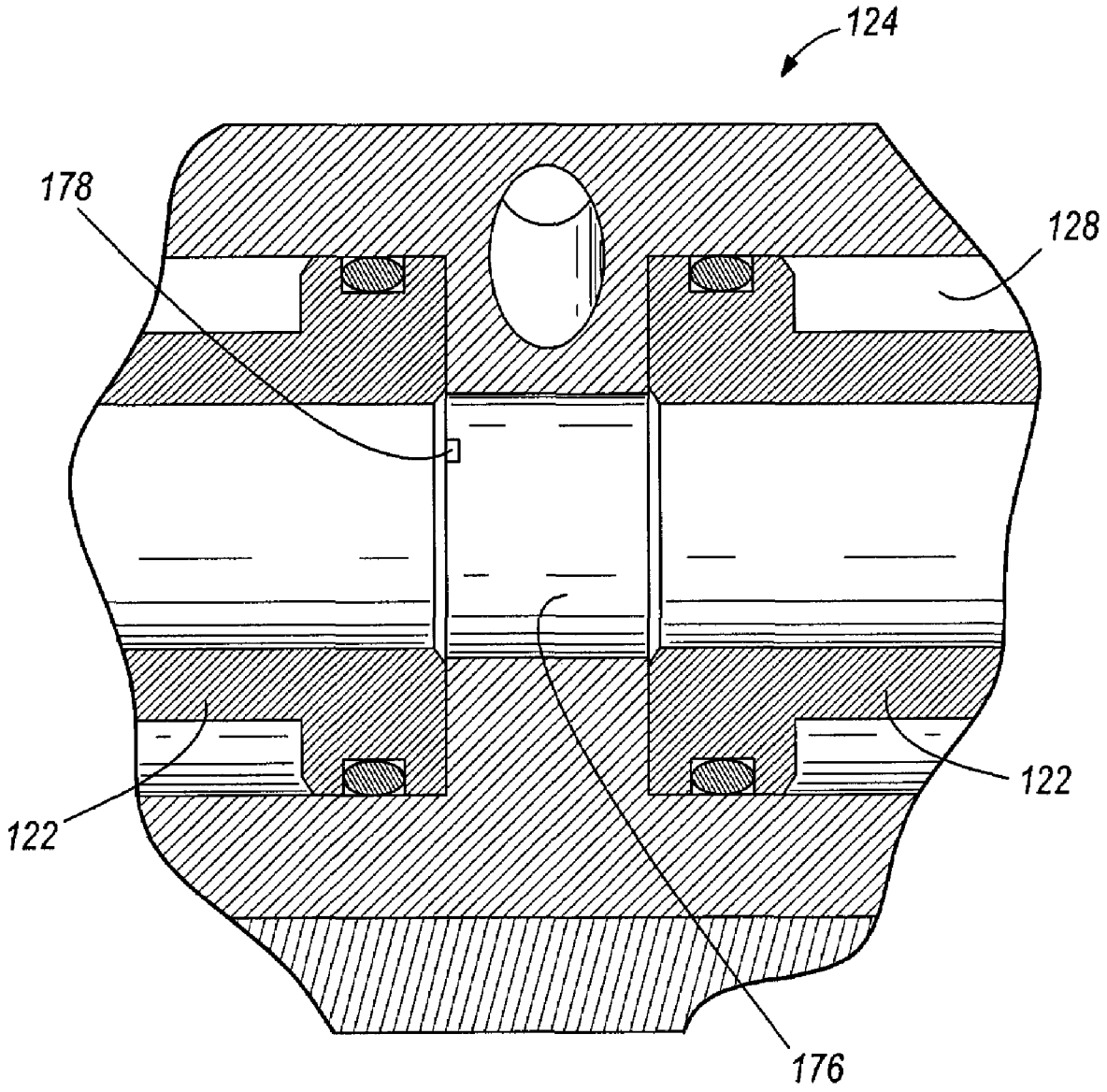
FIG. 4C is a detailed view of a portion of the cross-section of FIG. 4A, illustrating an orifice capable of permitting hydraulic oil to flow into and out of the housing.

FIGS. 4A and 4B illustrate a cross sectional view of the housing 124 of quick attachment mounting bracket 102 taken along line 4 as shown in FIG. 2. In addition, a portion of an attachment 114 positioned adjacent the quick attachment mounting bracket 102 is shown. FIG. 4A shows the engaging pins 122 in retracted position. FIG. 4B shows the engaging pins 122 in: an extended position. When the pins are in a retracted position, the base 162 of each of the engaging pins 122 is abutted against a reduced diameter portion 176 of cavity 128. The base 162 of the pins 122 include a groove 172 that extends circumferentially about the base of the pin. A seal (not shown) such as an O-ring can be disposed within the groove 172 to prevent hydraulic oil from moving within the cavity 128 from one side of the groove 172 to the other side. Spring 146 (not shown in FIGS. 4A and 4B) is positioned within the internal bores 166. When it is desired to extend the engaging pins 122, hydraulic oil is ported into the cavity 128 through a base orifice 178, which is shown in greater detail in FIG. 4C. As the pressurized hydraulic oil enters the reduced diameter portion 176 of the cavity 128, the hydraulic oil pushes against the internal bores 166 and the base 162 to cause the rods 164 to extend out of the cavity 128.

When the engaging pins 122 are positioned in a retracted state as shown in FIG. 4A, pressurized hydraulic oil (not shown) is positioned on the rod side 164 of the engaging pins 122. The hydraulic oil is ported into the cavity 128 through a pair of rod orifices (not shown), the rod orifices located such that one is on each side of the cavity, to overcome the spring 146 which is disposed within the cavities 166 of the engaging pins 122. Bushings 148 are held in position within the cavity 128 by a ring or clip 174 circumferentially located on an outer portion of the bushing. Each of the bushings 148 have one or more seals 149 such as o-rings on its outside diameter 147 to prevent hydraulic oil from leaking out of the cavity 128. Further, each of the bushings 148 have seals 145 such as o-rings between its inside diameter 143 and rod 164 of the engaging pins 122, thereby sealing the end of the cavity, while allowing the engaging pins 122 to extend through out of the housing 124 when it is desirable.

When the oil is ported into the reduced diameter portion 176 through orifice 178, the pins 122 are urged apart to extend out of the cavity 128 of the housing 124. As the pins extend, any hydraulic oil located on the rod side 164 of the engaging pins 122 is ported out of the cavity 124 through the rod orifices (not shown) on each side of the cavity 124. The hydraulic oil located within the cavity 124 between the base portions 162 of the pins will hold the pins extended. In addition, spring 146 applies a force against each of the engaging pins 122 to hold the pins in an extended position even if there is a loss of hydraulic pressure between the bases 162 of the pins within the cavity 128.

As shown in FIG. 4B, the engaging pins 122 extend out of the cavity 128 of the housing 124 and through bores located on each side of that portion of the attachment 114 positioned outside of the housing 124. After the engaging pins 122 have been fully extended, retaining pin 170 is inserted into the cross bore 168 on each of the pins 122 to provide additional retention for holding the attachment 114 onto the engaging pins 122.

As described above, hydraulic oil is used to extend the pins 122. To retract the pins 122, retaining pins 170 must be removed. Once the retaining pins 170 are removed, hydraulic oil is ported through the rod orifices (not shown) and into the cavity 128 on the rod 164 side of the engaging pins 122 to urge the engaging pins back toward the reduced diameter portion 176. At this time, the hydraulic oil located in the cavity between the pins 122 is urged out of the base orifice 178. A detailed description of how oil is ported into and out of the cavity 128 of the housing 124 will be discussed below.

Figure 5:
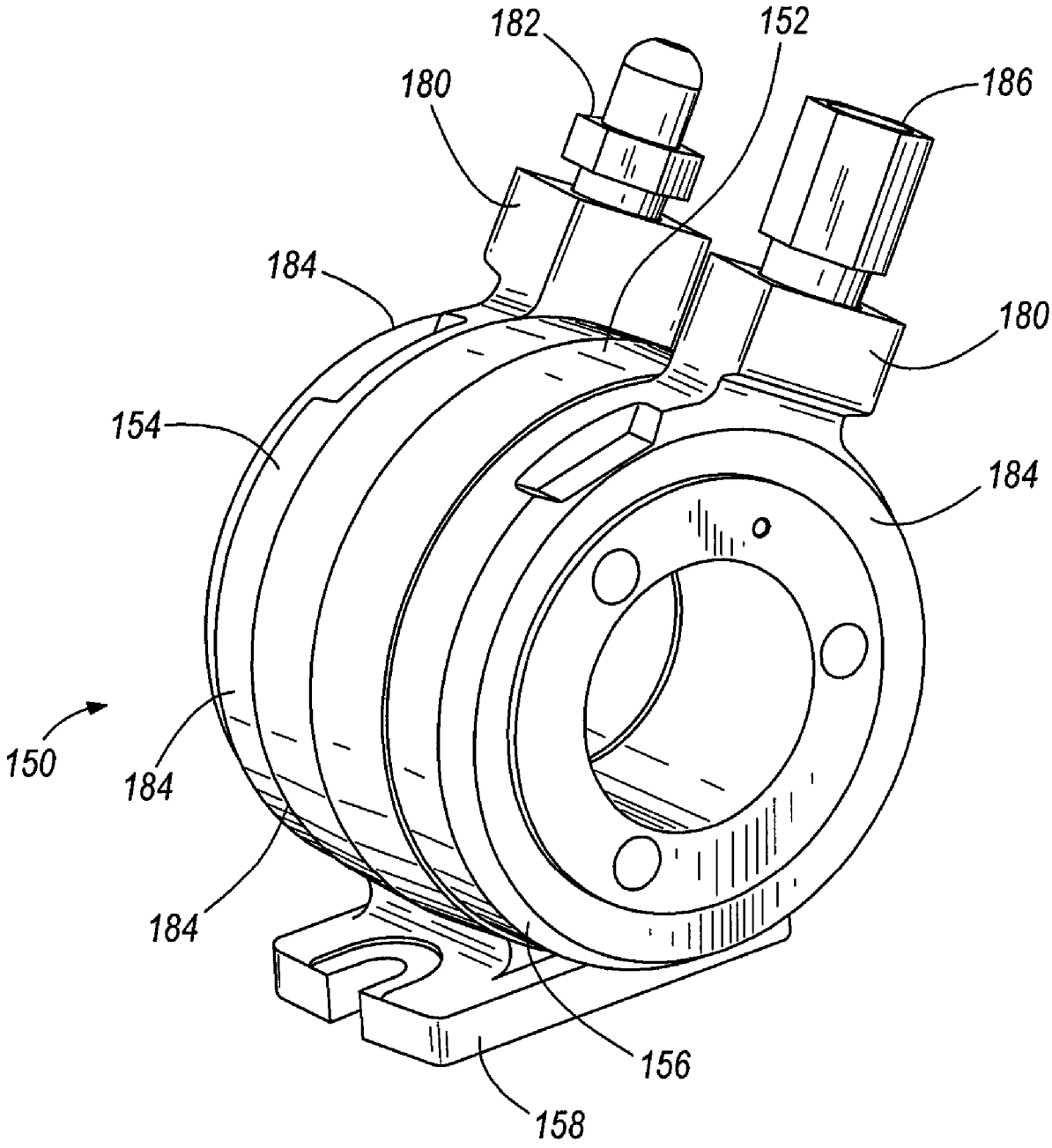
FIG. 5 is a perspective view of the pivotable hydraulic assembly of FIG. 2, illustrating hydraulic fittings attached to the assembly according to one embodiment.

FIG. 5 is a perspective view of the hydraulic interface 150 adapted to be positioned between the first link 136 and the second link 138 of the cylinder link assembly 130 at pivot 133. As shown in FIG. 5, first end portion 154 includes a port block 180 adapted to accept a first hydraulic fitting 182. A hydraulic fitting 182 is adapted to be connected to a first hydraulic line (not shown) from the excavator or backhoe, which allows hydraulic oil to be provided from a hydraulic source on the excavator or backhoe to the port block 180. Likewise, second end portion 156 includes a port block 180 adapted to accept a second hydraulic fitting 186. Fitting 186 is adapted to be fitted to a second hydraulic line (not shown) that is in communication with the hydraulic source on the power machine. First end portion 154 has a cavity (not shown) extending from the first hydraulic fitting 182 that allows oil to move through the first end portion. Likewise, second end portion 156 has a cavity extending from second hydraulic fitting 186 through the second end portion to allow oil to move through the second end portion.

Figure 6:
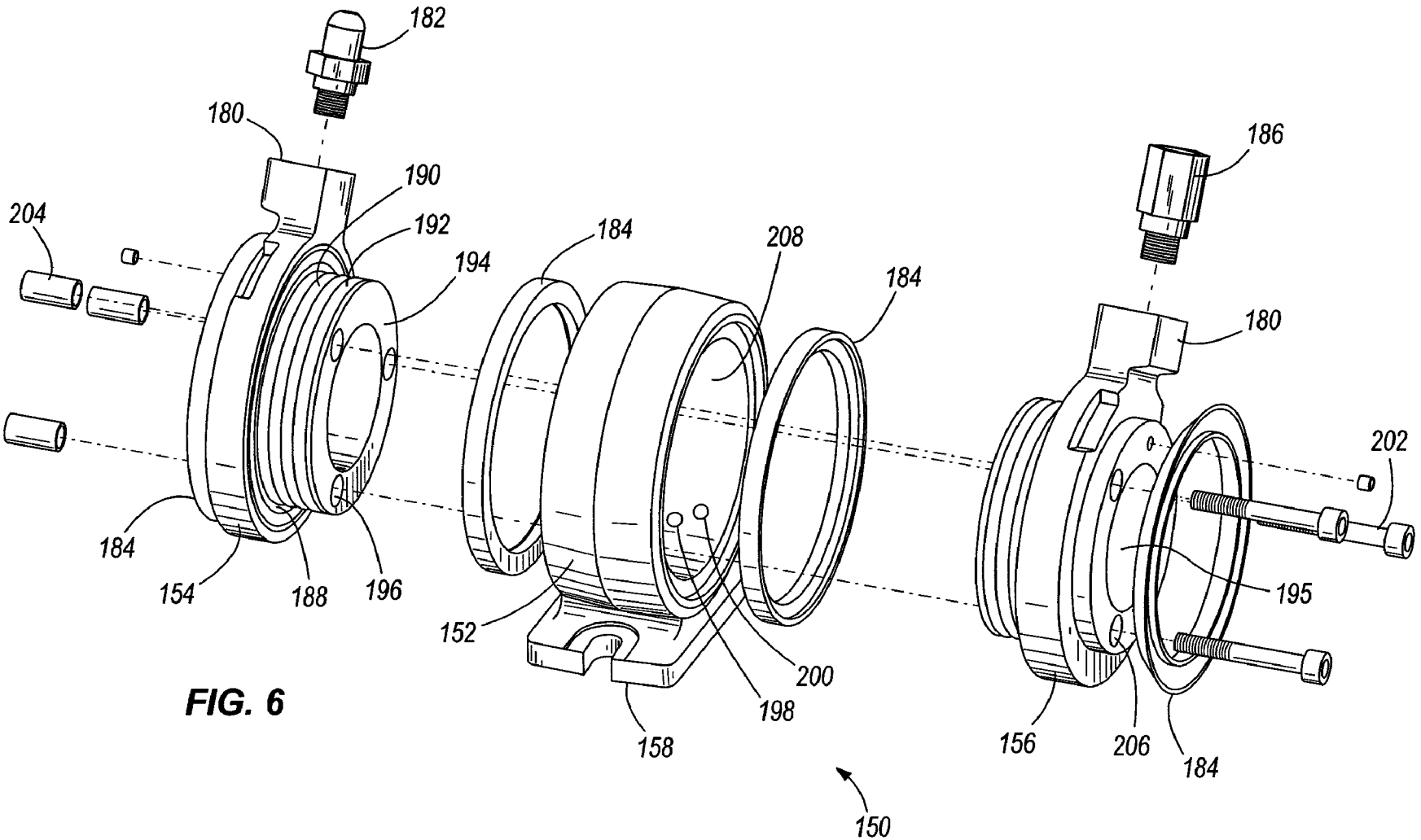
FIG. 6 is an exploded view of the pivotable hydraulic assembly of FIG. 5.

Referring to FIG. 6, hydraulic interface 150 is shown in an exploded view. Center portion 152 of hydraulic interface 150 includes a bore 208. Within the bore 208 are included a first orifice or pathway 198 and a second orifice or pathway 200. The first and second orifices 198 and 200 each extend through to separate outlets (not shown) on a bottom surface of center portion 152. The first and second orifices 198 and 200 allow oil to pass through them when aligned with the first and second end portions 154 and 156.

First end portion 154 includes a cylindrically-shaped shoulder 188 sized to fit within bore 208 of center portion 152. Shoulder 188 includes an outer seal 190 and an inner seal 192. A bore 194 extends through the first end portion 154. When first end portion 154 is positioned within center portion 152 the orifice 198 is located between the inner seal 192 and the outer seal 190. The first end portion 154, as described above, has a cavity extending from the first hydraulic fitting 182 that allows oil to pass from hydraulic lines attached to fitting 182. The internal cavity extends within the body of first end portion 154 to an orifice (not shown) positioned between the outer seal 190 and the inner seal 192. Thus, when first end portion 154 is positioned within the center portion 152, hydraulic oil that enters first hydraulic fitting 182 travels through the cavity within the first end portion, out the orifice, and into a volume that extends around the circumference of the shoulder 188 between the inner seal 192 and the outer seal 190. This oil is then capable of moving through the first orifice 198 and out of the hydraulic interface 150. Because the oil exits from the first end portion 154 into a volume that extends around the entire circumference of the shoulder 188, the first end portion 154 can pivot at any angle with respect to the center portion 152 without interrupting the flow of oil through the hydraulic interface 150.

Similarly, second end portion 156 has a pair of inner and outer seals (not shown) and an orifice (not shown) disposed between the inner and outer seals and in communication with internal cavity of the second end portion. Second end portion 156 also similarly includes a bore 195 extending through the second end portion. When the second end portion 156 is positioned within the center portion 152 of the hydraulic interface 150, orifice 200 is positioned within or between the inner and outer seals of the second end portion 156. Thus, oil that enters second hydraulic fitting 186 is capable of moving through the internal cavity and exiting the hydraulic interface through orifice 200. While the hydraulic oil is described as moving into one of the first and second hydraulic fittings 182 and 186 and out of the orifices 198 and 200, it is to be understood that hydraulic oil can move in the opposite direction as well.

Second end portion 156 includes a plurality of bores 206 that extend from an outer surface of the second end portion through the shoulder. The bores 206 are sized to accept fasteners 202. First end portion 154 has similarly positioned bores 196 such that when first and second end portions 154 and 156 are positioned within center portion 152, fasteners 202 extend through the second end portion and into the first end portion. Fastener couplers 204 are sized to fit within the orifices 196 of the first end portion 154. The fasteners 202 are engaged with the fastener couplers 204 to secure the first end portion to the second end portion. In one embodiment as shown in FIG. 6, the fastener couplers 204 are slotted nuts. Any other acceptable fastener coupler may be used including, without limitation, a thread cut into bore 196, a nut disposed within bore 196 or any other device. When the first and second end portions are positioned within center portion 152, seals 184 are disposed between the end portions and the center portion on either side of the center portion. Similarly seals 184 are positioned on the outer surfaces of the first and second end portions 154 and 156. In addition, bores 194 and 195 are aligned together to accept a pin (not shown) that couples the hydraulic interface 150 to cylinder link assembly 130 and quick attachment mounting bracket 102. The bores 194 and 195 have a diameter that is larger than the pin (not shown), so the hydraulic interface 150 has some freedom of movement with respect to the pin. Further the port blocks 180 are not rigidly connected to the cylinder link assembly 130. Thus, the load transmitted by cylinder link assembly 130 is transmitted to the pin and the hydraulic interface 150 is a non-load bearing device.

Returning briefly to FIG. 3, a mating surface 210 on cross member 112 is adapted to accept the center portion 152 of the hydraulic interface 150. The mating surface 210 includes a first orifice positioned to align with first orifice 198 of the center portion 152 of hydraulic interface 150, and a second orifice positioned to align with the second orifice 200 of the center portion (neither orifice is shown in FIG. 3). The first orifice on mating surface 210 is in communication with base orifice 178. Thus, oil that is ported into first hydraulic coupling 182 is capable of moving through orifice 178 and between the engaging pins 122. The second orifice is similarly in communication with the second hydraulic coupling 186 so that oil can be ported from the second hydraulic fitting to rod orifices located on each side of cavity 128 each of which is positioned on the rod side 164 of engaging pin 122.

When the hydraulic interface 150 is assembled, as described above, center portion 152 is fixedly attached to the cross member 112 of quick attachment mounting bracket 102. Thus the center portion 152 rotates with the quick attachment mounting bracket 102 when it rotates with respect to the cylinder link assembly 130. However, first end portion 154 and second end portion 156 are not attached to the cross member 112, and do not rotate with the quick attachment mounting bracket 102. In other words, the first end portion 154 and the second end portion 156 remain aligned with the cylinder link assembly 130 and not with the quick attachment mounting bracket 102. In one embodiment, quick attachment mounting bracket 102 can have up to 270 degrees of rotational travel with respect to the cylinder link assembly 130. Because the interfaces between the first and second end portions 154 and 156 and the center portion 152 are accomplished as described above, the quick attachment mounting bracket 102 can move without requiring hydraulic hoses to travel the up to 270 degrees of rotation.

Figure 7:
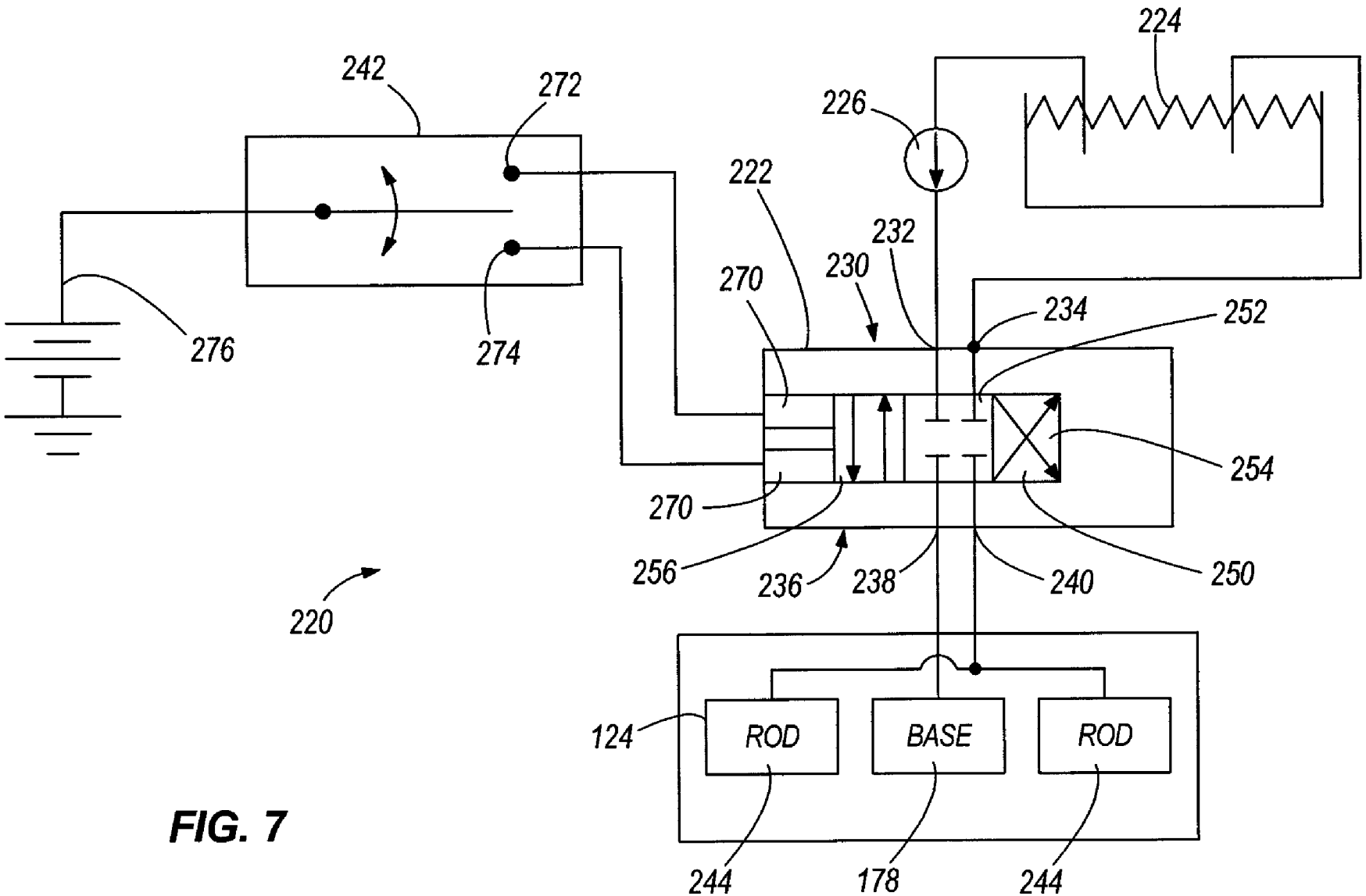
FIG. 7 is a schematic diagram illustrating a system for providing hydraulic oil to control the engagement members.

FIG. 7 is a simplified schematic 220 that illustrates the flow of hydraulic oil associated with extending and retracting the engaging pins 122 of quick attachment mounting bracket 102. Schematic 220 illustrates housing 124 which is hydraulically connected to a valve 222, which, in one embodiment, is located on the excavator or backhoe. Valve 222 has a pair of interfaces 232 and 234 on a first side 230 and a pair interfaces 238 and 240 on a second side 236. Interface 238 provides a connection between the valve 222 and first hydraulic fitting 182 and eventually to base orifice 178. Interface 240 is connected to second hydraulic fitting 186 and eventually to the pair of rod orifices 244. The rod orifices are designated as rod orifices 244 on FIG. 7 and are described above, but are otherwise not shown in any of the figures. Interface 232 on a first side 230 of valve 222 is coupled with the output side of pump 226. Interface 232 then, has pressurized oil available. Interface 234 is in communication with tank 224. Thus, interface at 234 is under no or minimal hydraulic pressure.

In one embodiment, the operator input 242 is a switch having two output poles 272 and 274. Input switch 242 is a three-position switch having a neutral or unactuated position wherein power from battery 276 is applied to neither output pole 272 nor output pole 274. In addition, input switch 242 has a first actuated position that provides battery power to output pole 272 and a second actuated position that provides battery power to output pole 274.

Valve 222 includes three positions, a neutral position 252, a first energized position 254, and a second energized position 256. Valve 222, in one embodiment, is actuated by one or more electronic actuators 270, which are coupled to the output poles 272 and 274 of the operator input 242. The electronic actuators 270, in one embodiment, are solenoids, which respond to a signal from output pole 272 by causing valve 222 to move to the first energized position 254 and to a signal from output pole 274 to cause valve 222 to move to the second energized position 256. If there is no signal present from either pole 272 or 274 electronic actuator causes or allows value 222 to move to a neutral position 252.

It is to be understood that the interface between the operator input 242 and the valve 222 can have many different implementations without departing from the scope of the embodiments disclosed herein. For example, electronic actuator 270 can include a pair of solenoids and the actuation of one or the other can cause the valve 222 to move into different positions. In Addition, any other type of actuator can be used, including, as an example, a linear actuator coupled to a valve spool to shift the spool into different positions. As another example, individual solenoid valves can be used to independently control the flow of oil from two interfaces 232 and 234 on the first side 230 of the valve 222 to the two interfaces 238 and 240 on the second side 236 of the valve. Further, actuator 270 can act indirectly on valve 222 by, for example, porting oil to shift a valve spool within valve 222. In addition, although operator input 242 is described above as a switch directly coupled to electronic actuator, the operator input can take a number of different forms, including a switch coupled to an electronic controller that, in turn, supplies signals to the valve 222.

When the valve 222 is in the neutral position 252, interfaces 238 and 240 are blocked so that no oil can travel in or out of the base orifice 178 or the rod orifices 244. Thus, the pins 122 remain in their current position, whether retracted or extended. It should be understood that valve 222 can have hydraulic components such as check valves or pilot operated check valves. Schematic 230 is a simplified schematic to show the functional results that occur when the valve 222 is in a particular position. Any number of implementations of valve 222 can be incorporated without departing from the scope of the embodiments described herein.

When the valve 222 is in the first energized position 254, the interface 238 is in communication with tank 224 to allow oil from the base orifice 178 to flow to tank. Further, interface 240 is in communication with interface 232, which supplies pressurized hydraulic oil to rod orifices 244. Thus, in the first energized position 254, the oil ported into the rod orifices 244 urge the engaging pins 122 to be retracted.

When the valve 222 is in the second energized position 256, the interface 238 is in communication with interface 232, which supplies pressurized hydraulic oil to the base orifice 178. Further, the interface 240 is in communication with tank 224 to allow oil from the rod orifices 244 to flow to the tank. Thus, in the second energized position 256, the oil ported into the base orifice 178 urge the engaging pins 122 to be extended.

The disclosed embodiments provides a number of advantages. By providing an arrangement of the type described above, an improved method of mounting attachments to equipment has been provided. Further, the addition of a hydraulic interface that allows oil to be ported through it even as the attachment is pivoting throughout its entire range of motion, the need for hydraulic supply lines that can withstand repeated cycles of rotation has been eliminated. In addition, the incorporation of retaining pins into the extended engagement members provides additional retention of any attachment that has been connected to the quick attachment mounting bracket.

Although several alternative embodiments have been described herein, workers skilled in the art will recognize that changes may be made in form and detail without departing from the spirit and the scope of the embodiments.

What is claimed is:

1. A hydraulic interface between a power machine having an hydraulic power system and an attachment mounting bracket pivotally mounted to the power machine having an hydraulically actuated engagement member for engaging an attachment and securing the attachment to the power machine, comprising:

a first portion having a path for accepting hydraulic oil including an inlet capable of being coupled to the hydraulic power system and an outlet; and a second portion fixedly attached to the attachment mounting bracket, wherein the first portion is pivotally coupled to the second portion and the second portion includes a first pathway capable of providing oil from the outlet of the first portion to the hydraulically actuated engagement member; and wherein the hydraulically actuated engagement member is capable of being actuated to secure or release an attachment to the power machine.

2. The interface of claim 1, wherein the second portion is fixedly coupled to the attachment mounting bracket so that the first pathway of the second portion is in communication with a first orifice that extends into the attachment mounting bracket to allow hydraulic oil to move from the hydraulic interface to the hydraulically actuated engagement member.

3. The interface of claim 1, wherein the first portion includes a cylindrically-shaped member that includes the outlet of the first portion, wherein the second portion includes a bore having a surface and is configured to accept the cylindrically-shaped member therein, and wherein the outlet of the first portion is positioned within the bore of the second portion when the first portion is pivotally coupled to the second portion.

4. The interface of claim 3, wherein the cylindrically-shaped member of the first portion includes a first seal and a second seal extending about the circumference of the cylindrically-shaped member, wherein the first and second seals engage the surface of the bore of the second portion to define a volume between the first and second seals, and wherein the outlet of the first portion is positioned between the first and second seals.

5. The interface of claim 4, wherein the first pathway of the second portion is in communication with the volume between the first and second seals.

6. The interface of claim 1, farther comprising a third portion fixedly attached to the first portion and pivotally coupled to the second portion, wherein the third portion includes a path for accepting hydraulic oil including an inlet capable of being coupled to the hydraulic power system and an outlet and wherein the second portion includes a second pathway capable of providing oil from the outlet of the third portion to the hydraulically actuated engagement member.

7. A power machine including a hydraulic power system, at least one arm, and an attachment interface system coupled to the arm and configured to be coupled to an attachment, the attachment interface system comprising;

an attachment mounting bracket pivotally attached to the at least one arm, including:

a first engagement member configured to engage and secure an attachment to the attachment mounting bracket, the first engagement member having an extendable portion configured to move between a first position and a second position under hydraulic power, wherein the extendable portion of the first engagement member is capable of engaging the attachment in the second position to fixedly couple the attachment to the power machine;

a housing having a cavity therein configured to accept the first engagement member, wherein the housing has a first orifice extending from an exterior surface of the housing into the cavity; and a hydraulic interface member including a first portion fixedly attached to the attachment mounting bracket and having a first internal path extending therethrough capable of accepting hydraulic fluid, the first internal path having an inlet and an outlet positioned to be in communication with the first orifice located on the exterior surface of the housing, and a second portion having an inlet capable of hydraulic communication with the hydraulic power system and an outlet in communication with the inlet of the first portion, wherein the second portion is capable of rotating with respect to the first portion.

8. The power machine of claim 7 further comprising a spring positioned within the housing to retain the first engagement member in the second position if the system experiences a loss of hydraulic power when the first engagement member is in the second position.

9. The power machine of claim 7, wherein the power machine further includes a hydraulic cylinder and a link having first and second ends, wherein the link is attached to the hydraulic cylinder at the first end and attached to both the attachment mounting bracket and the hydraulic interface at a pivotable coupling at the second end.

10. The power machine of claim 9, wherein the link transfers a load to the pivotable coupling and hydraulic interface is free from bearing the load.

11. The power machine of claim 7, wherein the housing includes a second orifice extending from the exterior surface of the housing into the cavity, and wherein the hydraulic interface member further includes a second internal path, extending from an inlet configured to be capable of communication with the hydraulic power system to an outlet positioned to be in communication with the second orifice.

12. The power machine of claim 7, wherein the attachment mounting bracket further comprises a second engagement member configured to move between a first position and a second position under hydraulic power for engaging and securing the attachment when in the second position.

13. The power machine of claim 12, wherein the cavity within the housing is configured to accept the second engagement member.

14. The power machine of claim 7, wherein the hydraulic power system is configured to provide hydraulic oil to the inlet of the first internal path of the hydraulic member in response to a remote signal and wherein an amount of the hydraulic oil is capable of being introduced into the cavity of the housing.

15. The power machine of claim 14, wherein the first engagement member is configured to move from the first position to the second position in response to the introduction of the amount of hydraulic oil into the cavity.

16. The power machine of claim 12, wherein the hydraulic power system is configured to provide hydraulic oil to the inlet of the second internal path of the hydraulic interface member in response to a remote signal, and wherein an amount of the hydraulic oil is capable of being introduced into the cavity of the housing.

17. The power machine of claim 16, wherein the first engagement member is configured to move from the second position to the first position in response to the introduction of the amount of hydraulic oil into the cavity.

18. A method of providing an attachment interface between an attachment and a power machine having an arm and a hydraulic power source, comprising:

pivotally attaching a mounting bracket configured to accept the attachment to the arm, the mounting bracket having at least one attachment engagement member, capable of moving between a first position and a second position under hydraulic power;

providing a hydraulic interface having an internal path for receiving hydraulic oil, the hydraulic interface including a first portion that is rotatable with respect to a second portion that is fixedly attached to the mounting bracket, wherein the internal path has an inlet for receiving hydraulic oil and the second portion has an outlet to provide oil to the mounting bracket and wherein the internal path extends through a pivot between the first portion and the second portion;

connecting the hydraulic interface to the hydraulic power source; and providing hydraulic oil from the hydraulic power source to move the at least one attachment engagement member between a first position and a second position in response to an operator input.

19. The method of claim 18, further comprising the step of positioning the attachment adjacent the mounting bracket, wherein the step of providing hydraulic oil from the hydraulic power source includes providing oil to move the at least one engagement member from the first position to the second position to secure the attachment to the mounting bracket.

20. The method of claim 18, further comprising the step of attaching a retaining pin to the at least one attachment engagement member.

21. The method of claim 18, further comprising the step of providing hydraulic oil from the hydraulic power source to move the at least one attachment engagement member from the second position to the first position to release the attachment from the mounting bracket.

* * * * *